US006162348A

United States Patent [19]

Ohmori

[11] Patent Number: 6,162,348

[45] Date of Patent: Dec. 19, 2000

[54] ELECTRODELESS ELECTROLYTIC DRESSING GRINDING METHOD AND APPARATUS

[75] Inventor: Hitoshi Ohmori, Wako, Japan

[73] Assignee: The Institute of Physical and Chemical Research, Saitama, Japan

[21] Appl. No.: 09/258,136

[22] Filed: Feb. 26, 1999

[30] Foreign Application Priority Data

Feb. 26, 1998 [JP] Japan ..... 10-045437

[51] Int. Cl.[7] ..... C25F 3/00

[52] U.S. Cl. ..... 205/663; 205/672; 204/224 R

[58] Field of Search ..... 205/662, 663, 205/672, 686; 204/224 M, 217

[56] References Cited

U.S. PATENT DOCUMENTS 4,849,599 7/1989 Kuromatsu ..... 204/224 M

FOREIGN PATENT DOCUMENTS 4-115867 4/1992 Japan .
6-170732 6/1994 Japan .

OTHER PUBLICATIONS

Patent Abstracts of Japan, vol. 097, No. 002, Feb. 28, 1997 & JP 08 257912 A (Nikkiso Co. Ltd.), Oct. 8, 1996.
Patent Abstracts of Japan, vol. 096, No. 012, Dec. 26, 1996 & JP 08 197425 A (Olympus Optical Co., Ltd.), Aug. 6, 1996.
Patent Abstracts of Japan, vol. 095, No. 011, Dec. 26, 1995 & JP 07 227761 A (Mitsubishi Electric Corp.), Aug. 29, 1995.
Patent Abstracts of Japan, vol. 018, No. 130 (M–1570), Mar. 3, 1994 & JP 05 318322 A (Brother Ind. Ltd.), Dec. 3, 1993.

*Primary Examiner*—Kathryn Gorgos
*Assistant Examiner*—Thomas H Parsons
*Attorney, Agent, or Firm*—Griffin & Szipl, P.C.

[57] ABSTRACT

A semi-conductive grindstone (10) comprising grains and a semi-conductive binder to fix the grains is prepared, a voltage is applied between the grindstone and the conductive workpiece (1), an conductive grinding fluid is supplied between them, the grindstone is contacted to the workpiece, the binder of the grindstone is subjected to electrolytic dressing in the contact point, and the workpiece is simultaneously ground by using the grindstone. A semi-conductive binder is preferably composed of metal powder and an insulating resin. Consequently, application is possible to peculiar grindstones such as ball-nose grindstone, grinding of the workpiece is simultaneously possible with dressing of the working surface of the grindstone by electrolytic dressing, and thus, grinding of long duration is also possible maintaining high efficiency and high preciseness.

10 Claims, 3 Drawing Sheets

ELECTRODELESS ELECTROLYTIC DRESSING GRINDING METHOD AND APPARATUS

BACKGROUND OF THE INVENTION

1. Field of the Invention

The present invention relates to an electrodeless electrolytic dressing grinding method and apparatus capable of grinding a workpiece and dressing the working surface of a grindstone simultaneously.

2. Description of the Related Art

Problems in the finishing process of a mold having a free form surface include a low degree of freedom of shape in the copying process with a grindstone and a necessary correction of the grindstone. Profile processing with a straight grindstone is restricted as to profiling shape due to the low degree of freedom of the diameter and the tip radius of the grindstone and a process machine itself. Further, the problems of a blade-like (thin blade) grindstone are that a working surface like a point causes a rough finished surface, and process preciseness is lowered by deflection of the grindstone. Therefore, most suitable for the finishing process of the mold is the use of a so-called ball-nose grindstone of which the tip is round.

However, the finishing process of a free surface using the ball-nose grindstone causes lowering of grinding efficiency after a short time and requires frequent dressing of the grindstone offline, because in-process dressing of the grindstone is impossible. This causes problems that are time consuming and difficult to reset the position of the grindstone resulting in low preciseness produced.

On the other hand, electrolytic in-process dressing grinding (hereafter, ELID grinding) was developed and published by the present applicants as a grinding means to achieve high efficient and ultra-precise mirror surface grinding that has been considered as impossible by conventional grinding art. In the ELID grinding, the conductive bonding part of a metal bond grindstone is dissolved by electrolytic dressing, therefore dressing and grinding are done simultaneously. The present grinding method allows efficient mirror finish for an ultra-hard material by using a metal bond grindstone having fine grains and has a characteristic capable of achieving high efficiency and ultra-preciseness.

However, the ELID grinding requires an in-process electrolytic step for the grindstone and, therefore, a space for installation of electrodes other than a working part is essential. Thus, such grindstone as the ball-nose grindstone having a small working surface of the grindstone and a peculiar shape has a problem that it is difficult to install electrodes near the working surface of the grindstone.

In order to solve these problems, the applicants of the present invention previously created "an electrolytic interval dressing grinding method" and submitted an application (Japanese Patent Gazette No. 1992-115867). In this method, as diagrammatically shown in FIG. 1, an electrode 3 is installed with a gap from the objective grinding material 1 (workpiece), an conductive grindstone 2, to which a voltage has been applied, is repeatedly moved between the workpiece 1 and the electrode 3, and a conductive grinding fluid is supplied between the conductive grindstone 2 and the workpiece 1 to carry out alternately electrolytic dressing and grinding process.

However, it is a problem that grinding by this method is inefficient and application to a peculiar grindstone such as the ball-nose grindstone is difficult, because alternation of the electrolytic dressing and grinding process is required.

Further, the applicants of the present invention created "an electrolytic dressing method and apparatus using an electrode contacting a semiconductor" and submitted an application (Japanese Patent Gazette No. 1994-170732). In this means, as diagrammatically shown in FIG. 2, a conductive grinding fluid is supplied to a gap between the conductive grindstone 2 having a contact surface to the workpiece 1 and the electrode 3 made of a semiconductor material and contacted to the working surface, a voltage is applied between the grindstone 2 and the electrode 3, and the grindstone 2 is subjected to dressing by electrolysis. For reference, 4, 5, and 6 represent a brush, an electric power source, and a nozzle.

The electrode 3 consisting of a semiconductor material allows electrolytic dressing of the grindstone by direct contact to the contacting surface (working surface) of the grindstone 2. This means also has a problem that application to a peculiar grindstone such as the ball-nose grindstone is difficult.

SUMMARY OF THE INVENTION

The present invention solves these various problems. The purpose of the present invention is to provide a grinding method and apparatus to allow applying to a peculiar grindstone such as the ball-nose grindstone, a grinding process while simultaneously dressing the working surface of the grindstone by electrolytic dressing, and thus providing grinding of long duration while maintaining high efficiency and high preciseness.

The present invention provides an electrodeless electrolytic dressing grinding method characterized by; (A) preparing a semi-conductive grindstone (10) comprising grains and a semi-conductive binder to fix the grains, (B) applying a voltage between the grindstone and the conductive workpiece (1), supplying conductive grinding fluid between them, contacting the grindstone to the workpiece, dressing the binder of the grindstone of the contact point by electrolytic dressing, and (C) simultaneously grinding the workpiece by the grindstone.

The present invention provides an electrodeless electrolytic dressing grinding apparatus comprising; a semi-conductive grindstone (10) comprising grains and a semi-conductive binder to fix grains, a voltage applying means (12) for applying a voltage between the grindstone and the conductive workpiece (1), and a supplying means (14) of grinding fluid for supplying conductive grinding fluid between the grindstone and the workpiece, whereby contacting the grindstone to the workpiece, dressing the binder of the grindstone of the contact point by electrolytic dressing, and simultaneously grinding the workpiece by the grindstone.

According to the method and apparatus of present invention, sparks generated between the semi-conductive binder and the workpiece can be prevented, the binder of the grindstone is subjected to electrolytic dressing in the contact point to dress the grindstone by contacting directly the semi-conductive grindstone (10), that is composed of grains and the semi-conductive binder to fix grains, to the workpiece having electrical conductivity, applying a voltage between them by a voltage applying means (12).

According to the preferred embodiment of the present invention, the semi-conductive binder is composed of mixture of metal powder such as copper powder and an insulating resin such as phenol resin. The semi-conductive binder can be set to have an electric resistance, that allows smooth electrolytic dressing operation without generating sparks, by changing mixing proportion (for example, 7:3) of metal powder and the insulating resin based on the component.

It is preferable that the semi-conductive grindstone (10) is a ball-nose grindstone. Applying the method and apparatus of present invention by using the ball-nose grindstone allows finishing process of a mold, etc. having a free surface by grinding continuously maintaining high efficiency and high preciseness for a long time.

Other purposes and beneficial characteristics of the present invention are known from the following description with reference to the drawings.

DETAILED DESCRIPTION OF THE PREFERRED EMBODIMENT

Herewith, the preferred embodiment of the present invention will be described with reference to the drawings. The same symbol is given to a common part in respective figures to omit a duplicate description.

Figure 1:
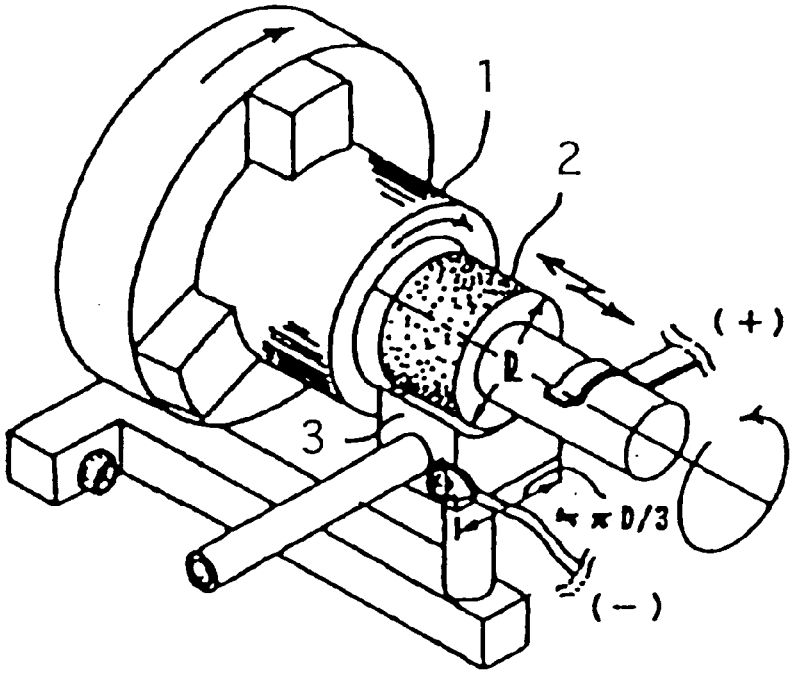
Fig. 1 (PRIOR ART)
FIG. 1 is a diagrammatic view of a prior art device by the applicants of the present invention.
Figure 2:
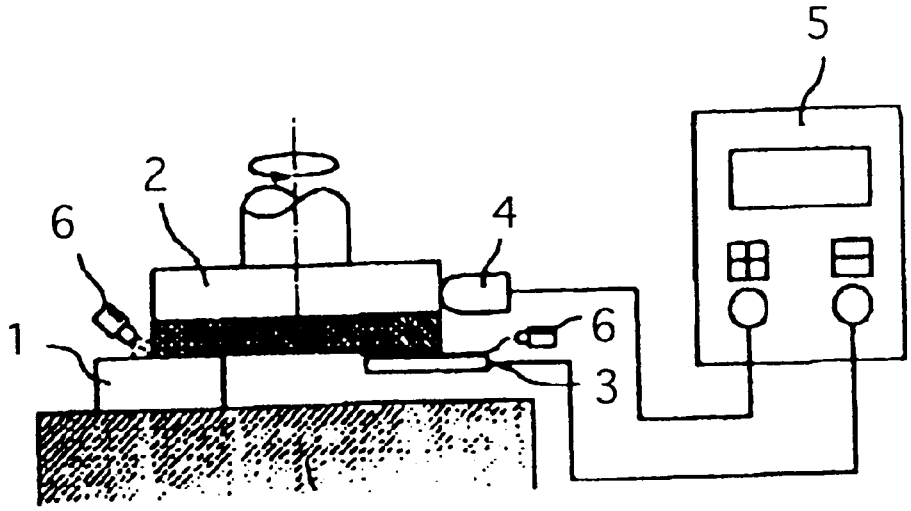
Fig. 2 (PRIOR ART)
FIG. 2 is another diagrammatic view of a prior art device by the applicants of the present invention.
Figure 3:
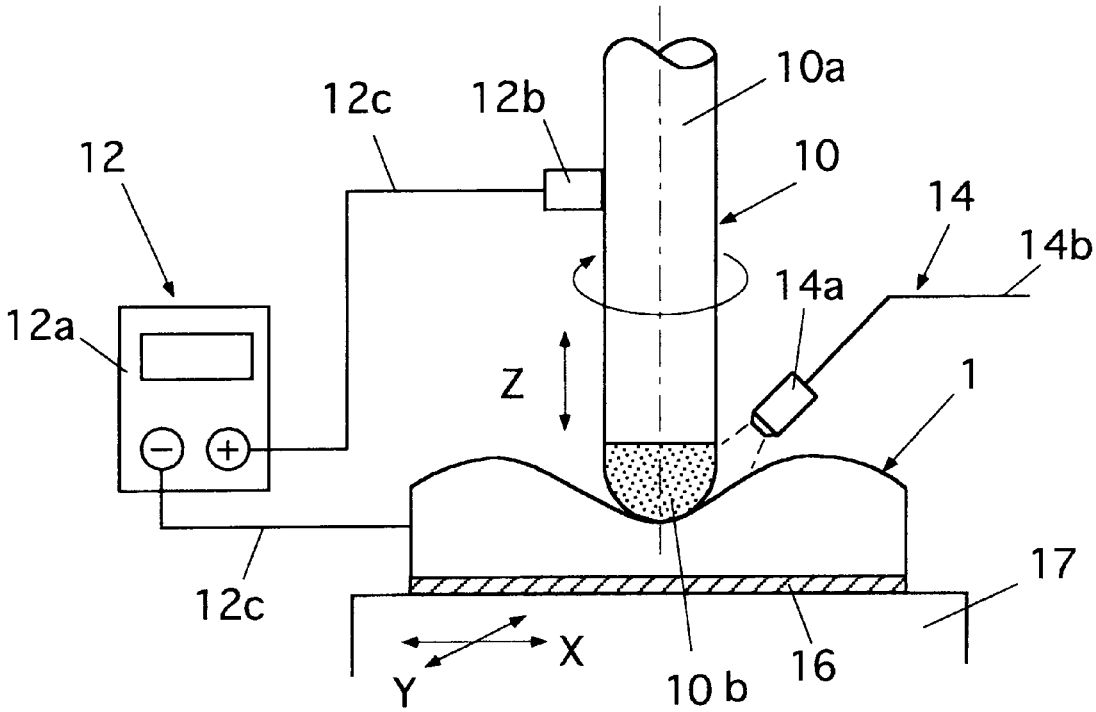
FIG. 3 is a structural diagrammatic view of an electrodeless electrolytic dressing grinding apparatus of the present invention.

FIG. 3 is a structural diagrammatic view of an electrodeless electrolytic dressing grinding apparatus of the present invention. In this figure, the electrodeless electrolytic dressing grinding apparatus of the present invention has the semi-conductive grindstone (10), a voltage applying means (12), and a supplying means (14) of grinding fluid.

In the mode for carrying out the claimed invention, the semi-conductive grindstone (10) is the ball-nose grindstone and comprises the shank 10*a* of the grindstone made of a metal with a high electric conductivity and the hemispheric grindstone part 10*b* installed in the tip (the bottom of the figure) thereof. The shank 10*a* of the grindstone is driven in high speed by a driving means around the center of the core of the shank, and controlled in Z direction (top and bottom directions) according to numeric control.

The grindstone part 10*b* of the semi-conductive grindstone 10 is composed of grains such as diamond or CBN and the semi-conductive binder to fix the grains. In addition, the semi-conductive binder is a mixture made of conductive metal powder and the insulating resin, and for example, formed by mixing and melting metal powder and the insulating resin. Copper powder is, for example, preferable for metal powder and other metal powder is also usable. A phenolic resin is, for example, preferable for the insulating resin and other insulating resins are also usable. The proportion of metal powder and the insulating resin is determined to obtain an appropriate electric resistance, prevent sparking phenomenon positioning of the resin between the workpiece, and operate an appropriate electrolytic dressing. The proportion of copper powder to the phenolic resin is preferably around 7:3.

The voltage applying means 12 comprises an electric power source 12*a*, a brush 12*b*, and an electric line 12*c* connecting a workpiece 1, the shank 10*a* of the grindstone, and the electric power source, and applies a voltage between the grindstone 10 and the workpiece 1. The electric power source 12*a* is preferably ELID power source of constant current capable of supplying pulsed direct current voltage. The brush 12*b*, in this embodiment, directly contacts to the outer surface of the shank 10*a* of the grindstone and applies a plus voltage to the grindstone 10 and minus voltage to the workpiece 1. The workpiece 1 is installed in X-Y table 17 that sandwiches the insulator 16, and controlled in horizontal directions according to numeric control.

The supplying means 14 of grinding fluid has a nozzle 14*a* aligned toward the contact part of the grindstone unit 10 with the workpiece 1 and a grinding fluid supplying line 14*b* to supply conductive grinding fluid to the nozzle 14*a*, and supplies conductive grinding fluid to the contact part of the grindstone 10 (specifically, the grindstone unit 10*b*) with the workpiece 1.

According to the method for electrodeless electrolytic dressing grinding of the present invention using the electrodeless electrolytic dressing grinding apparatus, a voltage is applied between the semi-conductive grindstone 10 and the workpiece 1, and the conductive grinding fluid is supplied between the grindstone and the workpiece, the grindstone 10 (the grindstone unit 10*b*) with the workpiece 1 for grinding the workpiece 1 by the grindstone 10. According to these steps, sparks generating between the semi-conductive binder and the workpiece 1 can be prevented and the bonding part of the grindstone can be subjected to electrolytic dressing in the contact point to dress the grindstone, because the semi-conductive grindstone 10 is composed of grains and the semi-conductive binder to fix grains. Therefore, the workpiece can be ground for process in the condition of contacting the grindstone 10 to the workpiece 1, as it is, simultaneously with dressing.

Figure 4:
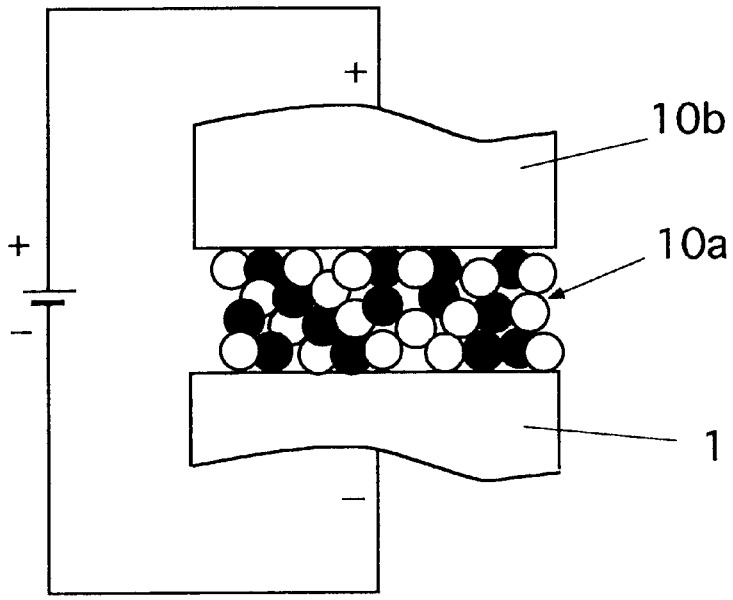
FIG. 4 is a diagrammatic view of a semi-conductive binder.

FIG. 4 is a diagrammatic view of a semi-conductive binder. As shown in this figure, the semi-conductive binder comprising the semi-conductive grindstone 10 is, as described before, a mixture made of conductive metal powder (shown with ●) and the insulating resin (shown with ○), and for example, formed by mixing and melting metal powder and the insulating resin. Therefore, sparking phenomenon is prevented by the presence of the resin between metal powder and the workpiece on the basis of that the semi-conductive binder is located between the workpiece 1 and an conductive member such as the shank 10*a* of the grindstone and the semi-conductive binder has an appropriate electric resistance, and appropriate electrolytic dressing occurs under the presence of the conductive grinding fluid keeping direct contact of the grindstone 10*b* with the workpiece 1.

Therefore, for example, applying the method and apparatus of the present invention by using the ball-nose grindstone allows finishing process of a mold, etc. having a free form surface by grinding continuously maintaining high efficiency and high preciseness for a long time.

Figure 5:
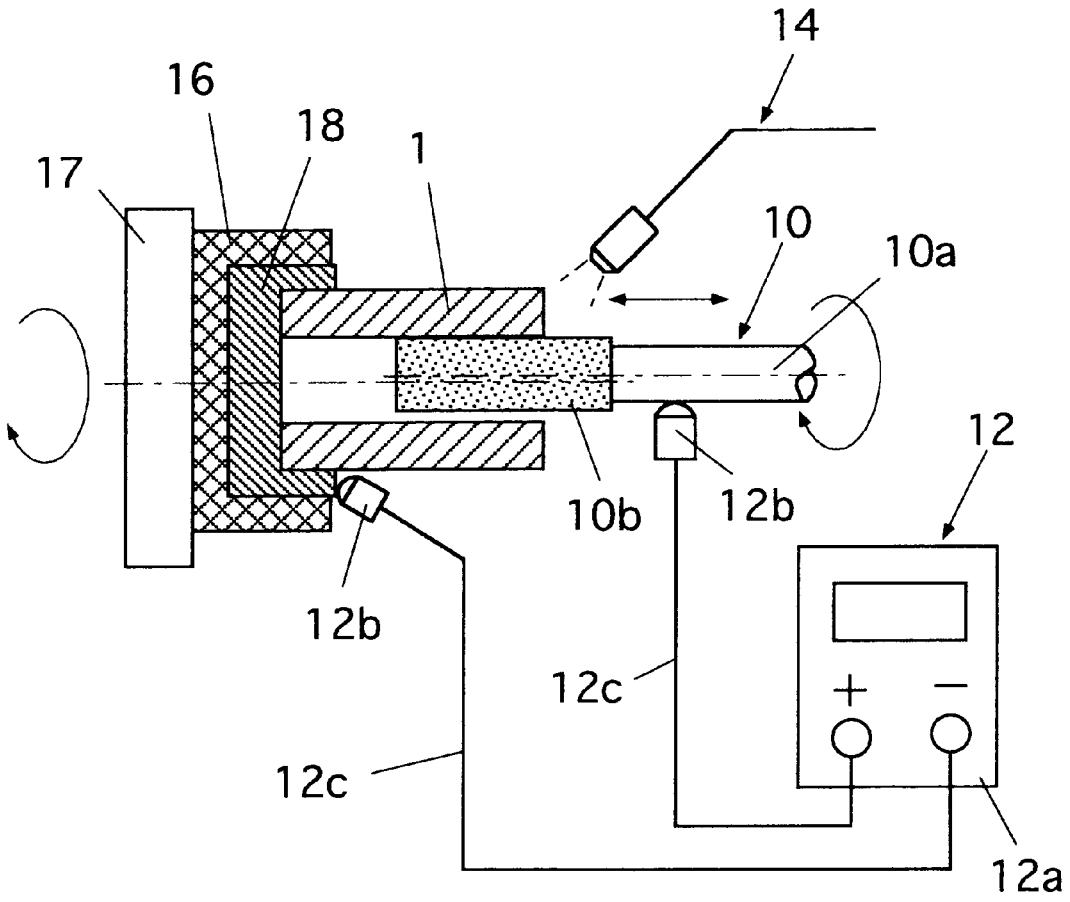
FIG. 5 is a structural diagrammatic view of another electrodeless electrolytic dressing grinding apparatus of the present invention.

FIG. 5 is a structural diagrammatic view of another electrodeless electrolytic dressing grinding apparatus of the present invention. In this figure, the electrodeless electrolytic dressing grinding apparatus of the present invention has the semi-conductive grindstone 10, the voltage applying means 12, and the supplying means 14 of grinding fluid.

In the mode for carrying out the claimed invention, the semi-conductive grindstone 10 is the grindstone with a very small diameter and composed of the shank 10*a* of the grindstone made of a metal with a high electric conductivity and the cylindrical grindstone unit 10*b* installed in the tip (the left-hand of the figure) thereof. The shank 10*a* of the grindstone is rotated in a high speed by a driving means, not shown in a figure, around the center of core of the shank, and controlled in X direction (left and right directions) and Z direction (top and bottom directions) according to numeric control.

The conductive workpiece 1 has a cylinder having an innernal diameter somewhat larger than that of the cylindrical grindstone unit 10*b* and installed in a rotating table 17 over the electric supplying body 18 and insulation 16.

The voltage applying means 12 comprises an electric power source 12*a*, a brush 12*b*, electric supplying body 18, and an electric line 12*c* connecting electrically the shank 10*a* and electric supplying body 18 to the electric power source, and thus applies a voltage between the grindstone 10 and the workpiece 1.

Other components are same as those of the mode for carrying out the claimed invention shown in FIG. 3. According to the present constitution, the present invention can be applied even when there is no space for installation of electrodes because of almost no difference between the internal diameter of the workpiece 1 and the external diameter of the grindstone 10.

Embodiments

The condition of the surface of a grindstone and working surface was observed and measured after surface processing of a steel piece (SKD11) for a mold by using the electrodeless electrolytic dressing grinding apparatus aforementioned. Table 1 and Table 2 show an outline of the apparatus used and the conditions of the process carried out, respectively.

TABLE 1

| Grinding machine | NC vertical milling machine |
|---|---|
| Grinding grindstone | Metal-resin-bond Mounted grindstone Size D20-R10 metal: resin = 7:3 |
| ELID power source | ELID power source of constant current |
| Grinding fluid | AFG-M Diluted with tap water 50 times |

TABLE 2

| Mesh size of grindstone | #80 | #200 |
|---|---|---|
| Rotation speed of grindstone (rpm) | 1000 | 1000 |
| Feed speed of X axis (mm/min) | 200–400 | 200 |
| Y axis depth of cut (μm) | 10–20 | 5–15 |
| Open-circuit voltage (V) | 20–60 | 20 |
| Peak current (A) | 5–10 | 5 |
| On/Off time (μsec) | 2 | 2 |

Initially, the electrodeless electrolytic process was carried out by using a #80 grindstone. Some sparks are generated between the grindstone and the workpiece under the electrolytic conditions of 60V-10A. Sparks occurred causing damage on the surface of the grindstone and the surface of the workpiece and therefore a good worked surface was not produced. A film particular in the ELID grinding under the electrolytic condition of 20V-6A was formed on the surface of the grindstone to allow good grinding surface like a mirror surface.

Subsequently, a feeding speed and a depth of cut were adjusted to increase process efficiency. An excessive feeding speed causes chattering and therefore a speed of about 200 mm/min produced a good worked surface. On the other hand, the depth of cut of 20 μm caused wear-down of the dressed surface, insufficient dressing by electrolytic dressing, and, finally loading. By a depth of cut of 16 μm or under, a grinding surface having a mirror-like surface is obtained.

In a process using a #200 grindstone, a comparative test was conducted in the absence and presence of electrification. In the electrified process (the present invention), the depth of cut of 10 μm caused a little wear of the dressed surface, however, around 5 μm allowed stable mirror finish processing. In the absence of electrification (conventional art), process was started in dressed condition. The depth of cut of 5 μm caused loading after a short time and the grindstone was worn and deformed.

From aforementioned embodiment, it has been confirmed that the electrodeless electrolytic dressing grinding method and apparatus of the present invention provide a good worked surface to accomplish stable processing by selecting optimal electrolytic conditions and process conditions according to the size of grains.

As stated before, the electrodeless electrolytic dressing grinding method and apparatus of the present invention have the following excellent effects: applicability to a peculiar grindstone such as ball-nose grindstone, possible grinding processing of the workpiece simultaneously with dressing of the working surface of the grindstone by electrolytic dressing, and thus, long duration grinding maintaining high efficiency and high preciseness.

The present invention has been described in conjunction with the preferred embodiment. The embodiment described herewith is to be considered in all respects as illustrative and not restrictive. In other words, the extent of the present invention includes all improvements, amendments, and the like included in the range of the claims attached herewith.

What is claimed is:

1. An electrodeless electrolytic dressing grinding method comprising the steps of:

(A) preparing a semi-conductive grindstone comprising grains and semi-conductive binder to fix the grains, (B) applying a voltage between the grindstone and the conductive workpiece, supplying conductive grinding fluid between them, contacting the grindstone to the workpiece, dressing the binder of the grindstone at the contact point by electrolytic dressing, and (C) simultaneously grinding the workpiece with the grindstone.

2. An electrodeless electrolytic dressing grinding method according to claim 1, wherein said semi-conductive binder is composed of a mixture of metal powder and an insulating resin.

3. An electrodeless electrolytic dressing grinding apparatus comprising a semi-conductive grindstone comprising grains and a semi-conductive binder to fix grains, a voltage applying means for applying a voltage between the grindstone and the conductive workpiece, and a supplying means of grinding fluid for supplying conductive grinding fluid between the grindstone and the workpiece.

4. An electrodeless electrolytic dressing grinding apparatus according to claim 3 wherein said semi-conductive binder consists of metal powder and an insulating resin.

5. An electrodeless electrolytic dressing grinding apparatus according to claim 4, wherein said semi-conductive grindstone is a ball-nose grindstone.

6. An electrodeless electrolytic dressing grinding apparatus according to claim 3, wherein by said semi-conductive grindstone is a ball-nose grindstone.

7. An electrodeless electrolytic dressing grinding apparatus comprising a semi-conductive grindstone comprising grains and a semi-conductive binder to fix grains, an electric power source, a brush, and an electric line connecting a conductive workpiece, a shank of the grindstone, and the electric power source for applying a voltage between the grindstone and the workpiece, and a nozzle aligned toward the contact part of the grindstone unit with the workpiece and a grinding fluid supplying line for supplying conductive grinding fluid between the grindstone and the workpiece.

8. An electrodeless electrolytic dressing grinding apparatus according to claim 7, wherein said semi-conductive binder consists of metal powder and an insulating resin.

9. An electrodeless electrolytic dressing grinding apparatus according to claim 8, wherein said semi-conductive grindstone is a ball-nose grindstone.

10. An electrodeless electrolytic dressing grinding apparatus according to claim 7, wherein said semi-conductive grindstone is a ball-nose grindstone.

* * * * *